US008457540B2

(12) United States Patent
Muramatsu et al.

(10) Patent No.: US 8,457,540 B2
(45) Date of Patent: Jun. 4, 2013

(54) FIXING DEVICE AND IMAGE FORMING APPARATUS INCORPORATING SAME

(75) Inventors: Satoshi Muramatsu, Yokohama (JP); Kunihiko Tomita, Yokohama (JP); Misaki Shimizu, Komae (JP)

(73) Assignee: Ricoh Company, Ltd., Tokyo (JP)

( * ) Notice: Subject to any disclaimer, the term of this patent is extended or adjusted under 35 U.S.C. 154(b) by 324 days.

(21) Appl. No.: 12/882,971

(22) Filed: Sep. 15, 2010

(65) Prior Publication Data

US 2011/0064493 A1 Mar. 17, 2011

(30) Foreign Application Priority Data

Sep. 15, 2009 (JP) ..... 2009-213295
Oct. 13, 2009 (JP) ..... 2009-236543
Feb. 5, 2010 (JP) ..... 2010-023831

(51) Int. Cl.
*G03G 15/20* (2006.01)

(52) U.S. Cl.
USPC ..... 399/329

(58) Field of Classification Search
USPC .. 399/107, 110, 122, 320, 328–331; 219/216, 219/619
See application file for complete search history.

(56) References Cited

U.S. PATENT DOCUMENTS 6,370,352 B1 4/2002 Tomita
6,505,028 B1 * 1/2003 Yoda et al. ..... 399/329
6,778,788 B2 8/2004 Tomita et al.
6,939,614 B2 9/2005 Tomita
7,046,949 B2 5/2006 Tomita et al.
7,254,360 B2 8/2007 Tomita
7,352,987 B2 4/2008 Iwata et al.
7,356,298 B2 4/2008 Tomita et al.
7,590,376 B2 9/2009 Tomita et al.
7,672,632 B2 * 3/2010 Sone et al. ..... 399/329
2003/0207194 A1 11/2003 Tomita
2008/0267674 A1 10/2008 Shimizu et al.
2008/0292373 A1 11/2008 Nakamura et al.
2009/0041513 A1 2/2009 Someya et al.
2009/0154967 A1 6/2009 Tomita

FOREIGN PATENT DOCUMENTS

JP 2001-083822 3/2001
JP 2003-167459 6/2003
JP 2004-139040 5/2004
JP 2004-167757 6/2004
JP 2004-325934 11/2004
JP 2005-017482 1/2005
JP 2005-258341 9/2005
JP 2007-108464 4/2007
JP 2007-148430 6/2007
JP 2008-169008 7/2008
JP 2009-151260 7/2009
JP 4298542 7/2009

* cited by examiner

*Primary Examiner* — Hoan Tran
(74) *Attorney, Agent, or Firm* — Oblon, Spivak, McClelland, Maier & Neustadt, L.L.P.

(57) ABSTRACT

A belt-fixing device to fix a toner image on a sheet includes an endless belt, a first roller disposed inside the endless belt, a second roller disposed in contact with the first roller via the endless belt, forming a fixing nip therebetween through which a recording medium passes, and a ring shape edge for controlling movement of the belt in an axial direction, provided on an inner surface of the endless belt. The ring shape edge is positioned between the first roller and the second roller.

20 Claims, 9 Drawing Sheets

FIXING DEVICE AND IMAGE FORMING APPARATUS INCORPORATING SAME

CROSS-REFERENCE TO RELATED APPLICATIONS

This patent specification claims priority from Japanese Patent Application Nos. 2009-213295, 2009-236543, and 2010-023831, filed on Sep. 15, 2009, Oct. 13, 2009, and Feb. 5, 2010, filed in the Japan Patent Office, each of which is hereby incorporated by reference herein in its entirety.

BACKGROUND OF THE INVENTION

1. Field of the Invention

The present invention relates to a fixing device to fix images on recording media, and an image forming apparatus, such as a printer, facsimile machine, copier, plotter, or multi-functional peripheral, employing the fixing device.

2. Discussion of the Background

Rendering visible image data using latent images formed using image forming apparatuses employing electrophotographic or electrostatic recording methods is used in a wide variety of fields.

For example, in the electrophotographic method, a latent image is formed on a photoreceptor according to image data by executing a charging process and an exposure process and then is developed with developer (e.g., toner) into a visible image, after which the image is recorded on a recording medium, such as a sheet of paper, by executing a transfer process and a fixing process.

In image forming apparatuses, such as printers, facsimile machines, copiers, plotters, or multi-functional peripherals having several of the foregoing functions, an unfixed image transferred onto the sheet is fixed thereon in the fixing process, and then the sheet is discharged as a printing output. Each of the image forming apparatuses includes a fixing device to execute the fixing process.

Fixing devices include a fixing roller, a heating roller heated by a heater, an endless belt wound around the fixing roller and the heating roller, a pressure roller that contacts an outer circumferential surface of the belt and pressures the fixing roller via the belt. The endless belt and the pressure roller contact and a nip area is formed in the contact area.

In this fixing device, when the sheet passes the nip area, the image is fixed on the sheet with heat and pressure by fusing an unfixed image. Alternatively, in other fixing devices, multiple belts press against each other to form the fixing nip, similarly to the above-described configuration.

These belt-fixing devices have the problem that the endless belt approaches a side of the belt-fixing device in the direction of the axis around which the belt is rotating. If the endless belt continues rotating in such a state (i.e. the belt continues to approach the side of the belt-fixing device in the direction of the axis), the endless belt may collide with the side board of the belt-fixing device and the endless belt may be damaged.

SUMMARY

In view of the foregoing, one illustrative embodiment of the present invention provides a belt-fixing device that includes an endless belt, a heater, a first roller, and a second roller. The first roller is disposed inside the endless belt. The second roller is disposed in contact with the first roller via the endless belt and forms a fixing nip through which a recording medium passes with the endless belt. The heater heats the endless belt. The endless belt has a ring shape edge for controlling movement of the belt in an axial direction. The ring shape edge is provided on an inner surface of the endless belt and is sandwiched between the first roller and the second roller.

Another illustrative embodiment of the present invention provides an image forming apparatus that includes an image carrier, a charging device to charge the image carrier uniformly, an exposure device to expose the charged surface of the image carrier, forming a latent image on the image carrier, a developing device to visualize the latent image formed on the surface of the image carrier, a transfer device to transfer the visualized image onto a recording medium directly or indirectly via an intermediate transfer member, and the belt-fixing device described above to fix the image on a recording medium.

BRIEF DESCRIPTION OF THE DRAWINGS

A more complete appreciation of the disclosure and many of the attendant advantage thereof will be readily obtained as the same becomes better understood by reference to the following detailed description when considered in connection with the accompanying drawings, wherein.

DETAILED DESCRIPTION OF PREFERRED EMBODIMENTS

Figure 1:
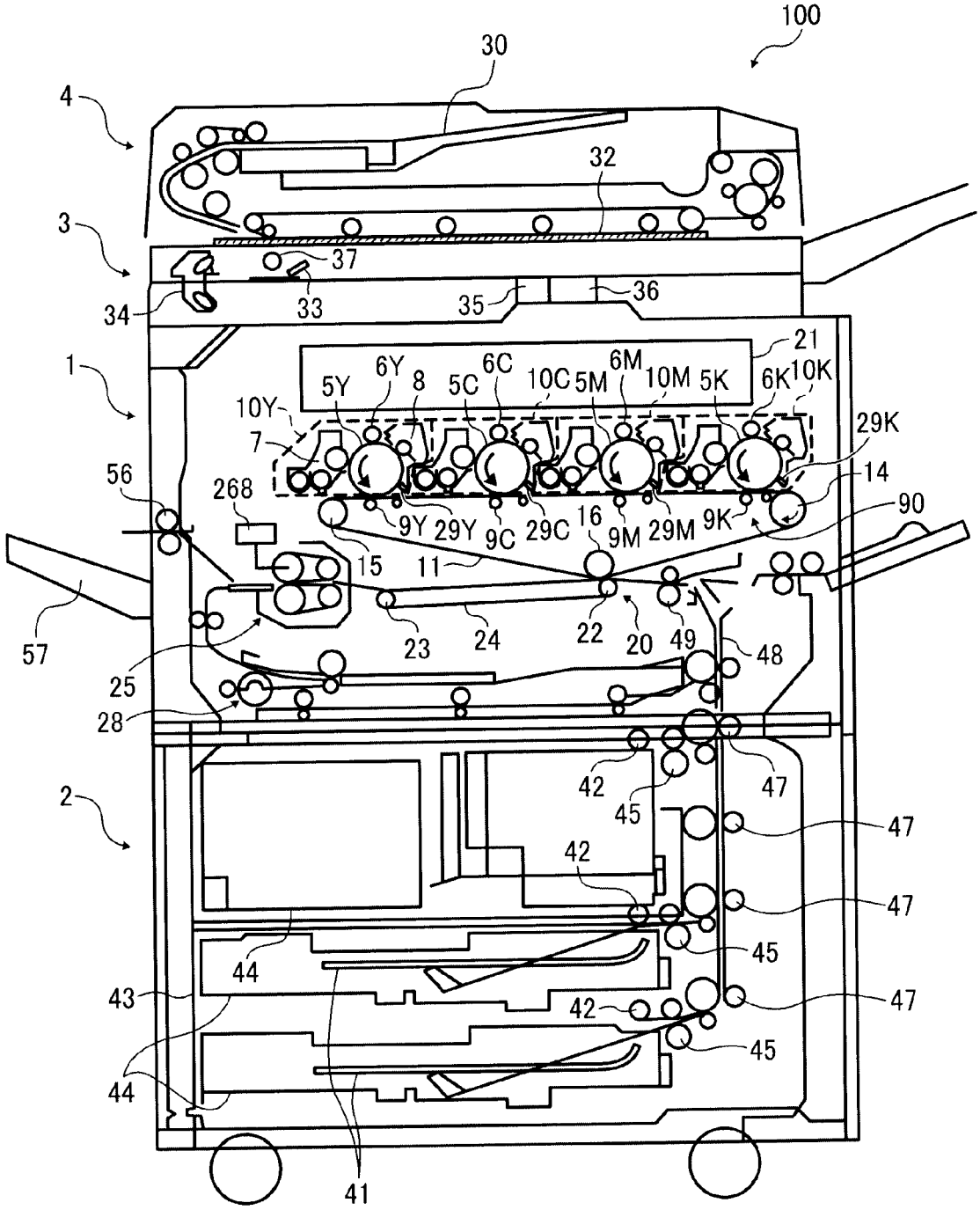
FIG. 1 is an overall schematic view illustrating a configuration of an image forming apparatus including a belt-fixing device according to one illustrative embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views thereof, particularly to FIG. 1, an image forming apparatus according to an example embodiment of the present invention is described below. It is to be noted that although the image forming apparatus of the present embodiment is a printer, the image forming apparatus of the present invention is not limited thereto.

(Image Forming Apparatus)

FIG. 1 is a schematic diagram illustrating a configuration of an image forming apparatus 100 that in the present embodiment is a multicolor image forming apparatus.

The multicolor image forming apparatus 100 is a tandem-type electrophotographic device including an intermediate transfer belt 11.

In FIG. 1, an automatic document feeder (ADF) 4, a scanner 3, and an image forming body 1 are stacked on a feed unit 2. The image forming apparatus 100 forms images through a latent image forming process, a developing process, a transfer process, a cleaning process, and a fixing process, executed in that order. A configuration of the image forming body 1 is described below.

In a center portion of the image forming body 1, a primary transfer device 90 including the intermediate transfer belt 11 is disposed. The primary transfer device 90 further includes four primary transfer members 9Y, 9M, 9C, and 9K, a driving roller 14, driven rollers 15 and 16, and a belt-cleaning device (not shown).

The intermediate transfer belt 11, which is a seamless (endless) belt, is wound around and is rotated by the driving roller 14 and the driven rollers 15 and 16. The belt-cleaning device (not shown) disposed on the left of the driven roller 15 removes residual toner adhering to the intermediate transfer belt 11 to prepare the intermediate transfer belt 11 for a next image forming process.

Above the primary transfer device 90, four image forming units 10Y, 10M, 10C, and 10K are disposed. It is to be noted that, in the image forming apparatus 100, reference character suffixes Y, M, C, and K attached to identical reference numerals indicate only that components indicated thereby are used for forming different single-color images, respectively, and hereinafter may be omitted when color discrimination is not necessary. Each image forming unit 10 includes a photoreceptor 5, a charging member 6, a developing device 7, a photoreceptor-cleaning blade 8, and an image density detector 29. The photoreceptors 5Y, 5C, 5M and 5K are rotatably disposed along the intermediate transfer belt 11. The developing devices 7, the charging device 6, the photoreceptor cleaner 8, and the image density detector 29 are disposed adjacent to the photoreceptors 5.

The developing device 7 develops an electrostatic latent image formed on the photoreceptor 5 with toner into a single-color toner image in the developing process. Although not depicted in the drawings, a discharging device and a lubrication coating device are disposed in the image forming unit 10 to assist in this process.

Above the image forming units 10, an exposure device 21, which includes a laser light source, is disposed. The exposure device 21 executes an electrostatic latent image forming process to form electrostatic latent images on the respective photoreceptors 5.

Beneath the primary transfer unit 90, a secondary transfer unit 20 that includes a secondary transfer member 22, a roller 23, and a conveyance belt 24 is provided. The secondary transfer member 22 is located beneath the intermediate transfer belt 11 to press against the driven roller 16 via the intermediate transfer belt 11. The secondary transfer member 22 collectively transfers single-color toner images superimposed one on another on the intermediate transfer belt 11 onto a sheet P, serving as a recording medium, conveyed between the secondary transfer member 22 and the intermediate transfer belt 11. It is to be noted that a transfer roller or a transfer member using a contactless type charger can be used as the secondary transfer member 22.

Thus, the primary transfer unit 90 and the secondary transfer unit 20 sandwiching the intermediate transfer belt 11 execute transfer processes.

Further, a belt-fixing device 25 is provided downstream from the secondary transfer device 22 in a direction in which the sheet P is conveyed (hereinafter "sheet conveyance direction"). The sheet P onto which the image is transferred is conveyed to the belt-fixing device 25 by the seamless conveyance belt 24 bridged between the secondary transfer member 22 and the roller 23. The belt-fixing device 25 fixes an image on the sheet P with heat and pressure, which is described in further detail later.

Further, a sheet reverse mechanism 28 that reverses the sheet P to form images on both sides of the sheet P in duplex printing is provided downstream from the belt-fixing device 25 in the sheet conveyance direction.

Moreover, a pair of discharge rollers 56 and a discharge tray 57 are disposed on a discharge side of the image forming body 1.

Basic operation of the image forming apparatus 100 is described below with reference to FIG. 1.

As sheet feeding modes, the image forming apparatus 100 has a normal mode and a manual feeding mode. When a user makes copies of a document D using the image forming apparatus 100, initially, in the normal mode, the user sets a document D on a document table 30 of the ADF 4. Alternatively, in the manual feeding mode, the user opens the ADF 4, sets the document D on a contact glass 32 of the scanner 3 disposed beneath the ADF 4, and then presses the document D with the contact glass 32 by closing the ADF 4.

Subsequently, when a start switch (not shown) is pushed in the normal mode, the document D is conveyed automatically to the contact glass 32, and then the scanner 3 is activated. Alternatively, in the manual feeding mode, the scanner 3 is immediately activated after the start switch is pushed. When the scanner 3 is activated, a first carriage 33 and a second carriage 34 begin moving. Therefore, a light source 37 disposed adjacent to the first carriage 33 emits a laser light onto the document D, and a pair of mirrors in the second carriage 34 turns 180 degrees in a direction in which the ray of light travels 180. Then, the ray of light passes though an imaging lens 35 and enters a reading sensor 36, and the contents of the document D are read by the reading sensor 36.

Along with these processes, when the start switch is pushed, the photoreceptor 5Y, 5M, 5C, and 5K are rotated, timed to coincide with the rotation of the intermediate transfer belt 11, and single-color toner images are formed on the respective photoreceptors 5. Then, the respective single-color toner images are superimposed one on another on the intermediate transfer belt 11 that rotates clockwise in FIG. 1, and thus a superimposed multicolor toner image is formed thereon.

Additionally, along with these processes, a feed roller 42 of a selected rack of the feed unit 2 rotates, and sheets P are fed out from a selected feed tray 44 in a feed unit 43 one by one from the top, separated by a separation roller 45. Then, the sheet P thus fed is conveyed, guided by a conveyance guide 48, to the image forming body 1 by multiple conveyance rollers 47 and is stopped by a pair of registration rollers 49.

Subsequently, timed to coincide with the arrival of the multicolor-toner image on the intermediate transfer belt 11, the pair of registration rollers 49 starts rotating to convey the sheet P between the intermediate transfer belt 11 and the secondary transfer member 22. Then, the multicolor-toner image is transferred onto the sheet P by the secondary transfer member 22.

Subsequently, the sheet P carrying a multicolor-toner image thereon is conveyed to the belt-fixing device 25 by the conveyance belt 24 in the secondary transfer device 20, and the belt-fixing device 25 executes a fixing process to fix the multicolor-toner image on the sheet P with heat and pressure.

Thereafter, the sheet P is guided toward the discharge side of the image forming apparatus and is discharged to the discharge tray 57 by the discharge roller 56.

Alternatively, when duplex printing to record images on both sides of the sheet is selected, after the image is formed on one side of the sheet P, the transfer-sheet P is fed to the sheet reverse mechanism 28. The sheet P thus reversed is conveyed to a position facing the secondary transfer member 22 so as to form an image on the other side of the sheet P, and then the sheet P is discharged to the discharge tray 57 by the discharge roller 56.

Herein, when monochrome images (black image) are formed on the intermediate transfer belt 11, the driven rollers 15 and 16 are moved but the driving roller 14 is not, and the photoreceptors 5Y, 5C, 5M for the yellow, cyan, and magenta are separated from the intermediate transfer belt 11. Additionally, if an image forming apparatus that is not a tandem-type apparatus as shown in FIG. 1 but is a one-drum type and includes only a single photoreceptor drum is used, generally, a black image is initially formed so as to increase the first copy speed, after which other color images are formed when multicolor images are formed.

Figure 2:
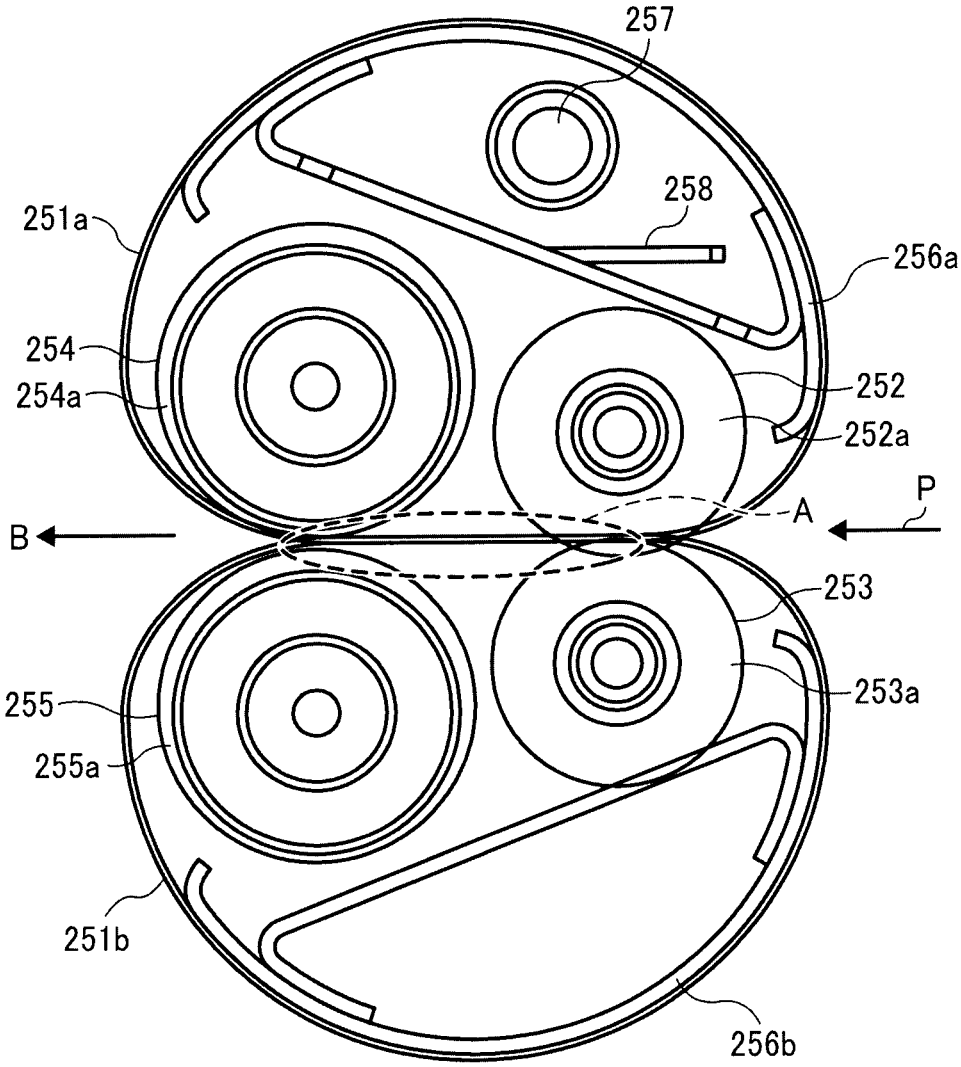
FIG. 2 is a cross-sectional diagram illustrating a configuration of the belt-fixing device shown in FIG. 1.

FIG. 2 is a cross-sectional diagram illustrating a configuration of the belt-fixing device 25 according to the present embodiment.

As shown in FIG. 2, the belt-fixing device 25 includes two endless belts, a first endless-fixing belt 251*a* and a second endless-fixing belt 251*b*, that are disposed in contact with each other, and a contact area therebetween is hereinafter referred to as "nip A". A first nip-roller 254 and a first guide-roller 252 are disposed inside the first belt 251*a*, and a second nip-roller 255 and a second guide-roller 253 are disposed inside the second belt 251*b*. The first nip-roller 254 and the first guide-roller 252 are disposed facing the second nip-roller 255 and the second guide-roller 253, respectively, pressing the first belt 251*a* and the second belt 251*b* at the nip A against each other.

A predetermined pressure is exerted between an axis of the first nip-roller 254 and an axis of the second nip-roller 255 by a pressing member (not shown) such as a compression spring. The first nip-roller 254 is rotated by a driving source 268 (shown in FIG. 1) of a driving mechanism 260 via a gear mechanism 261 (shown in FIG. 3). Further, the first nip-roller 254 and the second nip-roller 255 are formed of a metal core and a rubber layer surrounding the metal core.

Additionally, the first guide-roller 252 is located upstream from the first nip-roller 254 in the sheet conveyance direction inside the first endless belt 251*a*, and the second guide-roller 253 is located upstream from the second nip-roller 255 in the sheet conveyance direction inside the second belt 251*b*. Therefore, in an area where the sheet is conveyed linearly, the rollers 252, 253, 254, 255 function as support members to form the nip A, that is, the contact area between the first endless belt 251*a* and the second endless belt 251*b*. A predetermined pressure is exerted between an axis of the first guide-roller 252 and an axis of the second guide-roller 253 by a pressing member (not shown) such as a compression spring. In this configuration, the first nip-roller 254 serves as a first-roller, the first guide-roller 252 serves as a third roller, the second nip-roller 255 serves as a second roller, and the second guide-roller 253 serves as a fourth roller.

Further, the first guide-roller 252 and the second guide-roller 253 are formed of a metal core and an elastic material, such as rubber or sponge rubber, surrounding the metal core. Thus, a certain degree of nip pressure is generated in the nip A by repulsion force of the cylindrical first fixing belt 251*a* and second fixing belt 251*b* attempting to revert to a cylindrical shape.

Additionally, a halogen heater 257 and a reflection plate 258 are provided inside the first endless belt 251*a*, thereby intensively heating an upper side of the first endless belt 251*a* from inside. Such a configuration dramatically reduces heat leakage, thus improving heating efficiency.

Figure 3:
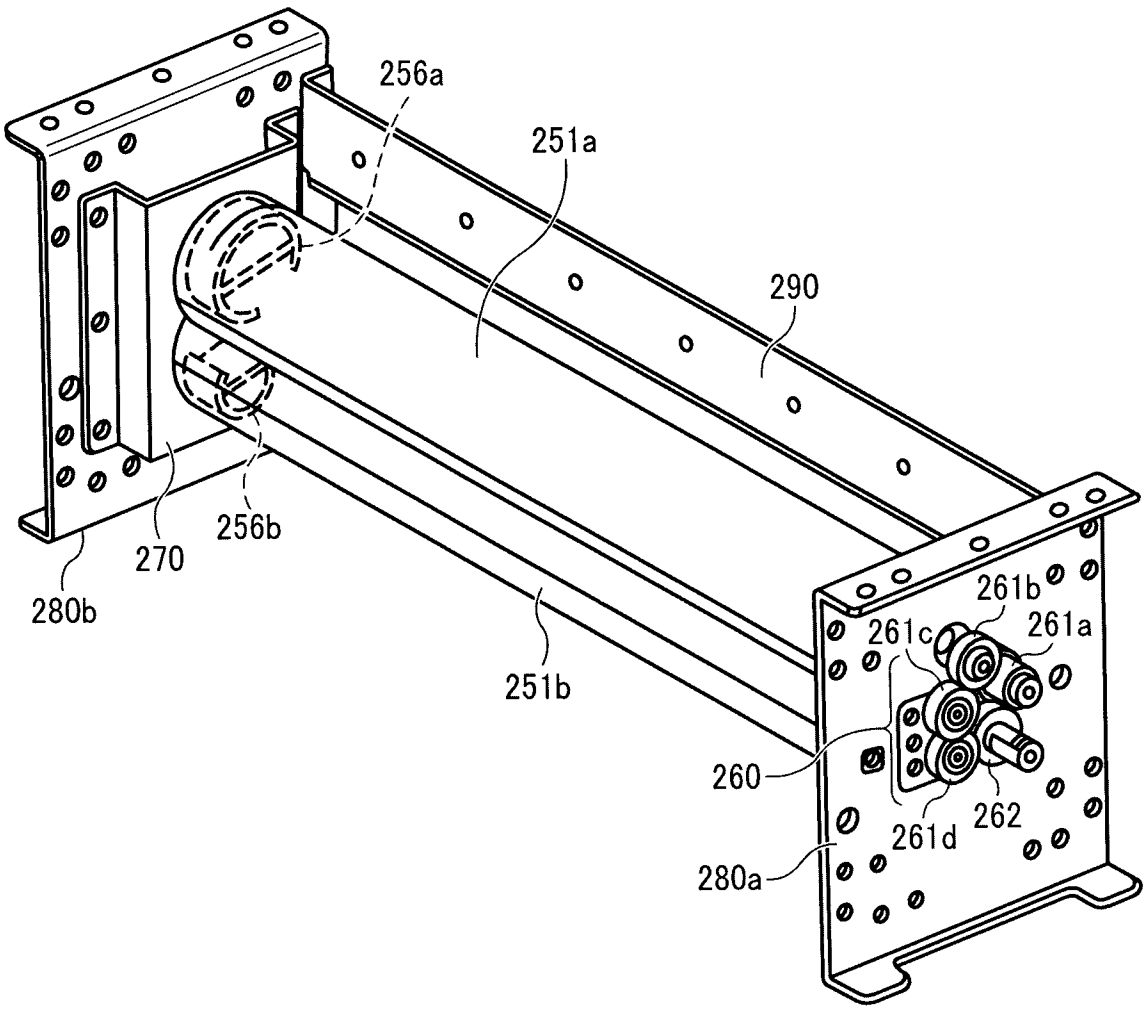
FIG. 3 is a perspective view illustrating the belt-fixing device shown in FIG. 2.

FIG. 3 is a perspective view illustrating the belt-fixing device 25 as a whole. As shown in FIG. 3, the belt-fixing device 25 further includes a front side board 280*a*, a back side board 280*b*, the driving mechanism 260 disposed on the front side board 280*a*, a stay 290 extending between the front side board 280*a*, and the back side board 280*b* parallel to the first endless belt 251*a*, and a pair of wrinkle prevention plates 270.

As the driving mechanism 260 drives the first nip-roller 254, the first endless belt 251*a* rotates, which rotates the first guide-roller 252, the second endless belt 251*b*, the second nip-roller 255, and the second guide-roller 253. The driving mechanism 260 and both ends of the first endless belt 251*a* and the second endless belt 251*b* are supported by respective bearing assemblies provided on the front side board 280*a* and the back side board 280*b*.

In general, in order to obtain a glossy image, the extent of contact of the toner image when present between a fixing roller and a pressure member (e.g., rubber roller) to be heated (hereinafter "nip contact") must be sufficient. In order to secure the needed nip contact, the size of the contact area between the heating member and rubber roller in the sheet conveyance direction, that is, a contact width or nip width, should be sufficiently large.

In the present embodiment, the length (width) of the nip A sandwiched by the multiple belts can be as long as a perimeter of the belts permits. Therefore, glossy images can be obtained in the fixing process.

Herein, the belt-fixing device 25 depicted in FIG. 2 further includes a first guide-member 256*a* disposed inside the first endless belt 251*a* and a second guide-member 256*b* disposed inside the second endless belt 251*b*. The first guide-member 256*a* and the second guide-member 256*b* function as a guide mechanism to prevent the first endless belt 251*a* and the second endless belt 251*b* from leaning to one side and to promote rotation of the belts. Additionally, the first guide-member 256*a* and the second guide-member 256*b* can make the nip A longer. Then, a certain degree of nip pressure is generated in the nip A by repulsion force of the cylindrical first endless belt 251*a* and second endless belt 251*b* attempting to revert to a cylindrical shape.

As shown in FIG. 2, the first guide-member 256*a* extends along almost the entire circumference of the first endless belt 251*a* except a portion around the nip A, and the second guide-member 256*b* extends along almost the entire circumference of the second endless belt 251*b* except a portion around the nip A.

In a longitudinal direction of the belt-fixing device 25 perpendicular to the sheet conveyance direction, the first guide-member 256*a* and the second guide-member 256*b* are disposed only in end portions on both sides shown in FIG. 3 where the sheet P does not contact (non-image portion) to minimize sliding resistance between the guide-members 256 and the belts 251 as well as heat capacity of the belt-fixing device 25. Therefore, vibration of the first endless belt 251*a* and the second endless belt 251*b* can be prevented or reduced.

Additionally, when the belt-fixing device 25 according to the present embodiment is used in an image forming apparatus such as a copier, a favorable nip A can be easily formed. Therefore, expanding the roller fixing device to increase the nip width is not required, and the cost can be reduced. Moreover, load on the end portions of the belt can be reduced.

In the present embodiments, the first endless belt 251*a* and the second endless belt 251*b* are driven by driving the first nip-roller 254 and the second nip-roller 255. The first nip-roller 254 is driven by the driving source 268 (shown in FIG. 1) via the first nip-gear 261*a*. The second nip-roller 255 is rotated together with the first nip-roller 254 by sliding of the first endless belt 251*a* and the second endless belt 251*b*, and the second nip-roller 255 is rotated at same velocity as the first nip-roller 254.

In the configurations shown in FIG. 3, the belt-fixing device 25 does not include a gear to transmit the driving force from the first nip-roller 254 to the second nip-roller 255. Alternatively, the second nip roller 255 may be rotated by rotation of the first nip-roller 254 via the first endless belt 251*a* and the second endless belt 251*b*. If the perimeter of the rollers and degree by which the rubber is compressed are identical in the two rollers, both rollers may be rotated at the same velocity via a gear. However, actually, the perimeters slightly differ between the two rollers because of tolerance and variation in manufacturing process, and accordingly, using the gear to transmit the driving force in the first nip-roller 254 to the second nip-roller 255 may cause deviation therebetween in the velocity. Therefore, rotation of the second nip-roller 255 by the first nip-roller 254 is preferable for rotating the two rollers at the same velocity.

Herein, with reference to FIG. 3, the gear mechanism 260 in the belt-fixing device 25 includes the first nip-gear 261*a*, an idler gear 261*b*, a first guide-gear 261*c*, a second-guide gear 261*d*, and a bearing 262 of the second nip-roller 255. The first nip-gear 261*a* that is attached to a shaft of the first nip-roller 254 engages the first guide-gear 261*c* that is attached to a shaft of the first guide-roller 252 via the idler gear 261*b*, and the rotation of the first nip-roller 254 is transmitted to the first guide-roller 252. The first nip-gear 261*a* serves as a first gear, the first guide-gear 261*c* serves as a second gear, the second guide-gear 261*d* serves as a third gear. In the driving mechanism 260, the second-guide gear 261*d* that is attached to the shaft of the second guide-roller 253 engages the first guide-gear 261*c* at a same number of teeth.

Therefore, because the driving force is transmitted from the first guide-gear 261*c* to the second guide-gear 261*d* at the same velocity, the first guide-roller 252 and the second guide-roller 253 rotate at almost the same velocity, and tensile force of the first belt 251*a* and the second belt 251*b* can be stable. In the configurations shown in FIG. 3, because the tensile force of the first endless belt 251*a* disposed facing the image face of the sheet P can be stable, the above-described failures can be prevented or reduced. Additionally, because the tensile force of the first endless belt 251*a* and the second endless belt 251*b* can be stable, the image quality can be further improved.

Next, vibration of the belts is described below with reference to FIG. 2.

The nip A is almost linear as shown in FIG. 2, and, when the first endless belt 251*a* and the second endless belt 251*b* are driven, the exit of the nip A receives a pressing force in a direction indicated by arrow B shown in FIG. 2 by inertial force of the nip A, and the first endless belt 251*a* and the second endless belt 251*b*, except the portions around the nip A, try to move in the direction indicated by arrow B. However, restorative force becomes relatively strong when the first endless belt 251*a* and the second endless belt 251*b* are deformed to a certain degree. In other words, at this time, the force is exerted in a direction opposite the direction indicated by arrow B.

Therefore, the first endless belt 251*a* and the second endless belt 251*b* are vibrated by fluctuation in the balance between the force in the direction indicated by arrow B and the force in the opposite direction. When the first belt 251*a* and the second belt 251*b* vibrate, the inner circumferential surfaces of the first endless belt 251*a* and the second endless belt 251*b* slide on the respective surfaces of respective first guide-member 256*a* and second guide-member 256*b*. Thus, attrition of the belt, the torque, and/or noise all increase.

Therefore, the surfaces of the first guide-member 256*a* and the second guide-member 256*b* are coated with a slippery material, such as Teflon (registered trademark), to reduce vibration of the belt.

It is to be noted that, hereinafter, the first nip-roller 254 and the second nip-roller 255 disposed downstream in the sheet conveyance direction in the nip A are simply referred to as nip-rollers collectively when discrimination therebetween is not necessary, and the first guide-roller 252 and the second guide-roller 253 disposed upstream in the sheet conveyance direction in the nip A are simply referred to as guide-rollers collectively when discrimination therebetween is not necessary.

Next, looseness and a gap of the belts is described below with reference to FIG. 2.

Referring to FIG. 2, when the sheet P onto which an unfixed image is transferred passes through the nip A in a direction indicated by arrow B shown in FIG. 2, the first endless belt 251*a* contacts the image face of the sheet P, and the toner on the sheet P is heated.

Herein, when the first endless belt 251*a* or the second endless belt 251*b* loosens or gaps are created between them in the nip A, that is, the first endless belt 251*a* and the second endless belt 251*b* are not sufficiently in contact with each other, the toner cannot be heated adequately, and therefore, image failures, such as, image misalignment, gloss shortage, and/or white void, occur. In order to resolve these image failures, the peripheral velocity (peripheral linear velocity) of the guide-rollers is slower than that of the nip-rollers. Accordingly, tensile force of the first endless belt 251*a* in the fixing nip A can be stable, thereby enhancing the contact force between the first endless belt 251*a* and the second endless belt 251*b*. Therefore, in the belt-fixing device 25 in the present embodiment, the image failures, such as image misalignment, gloss shortage, and white void, can be prevented.

Figure 4:
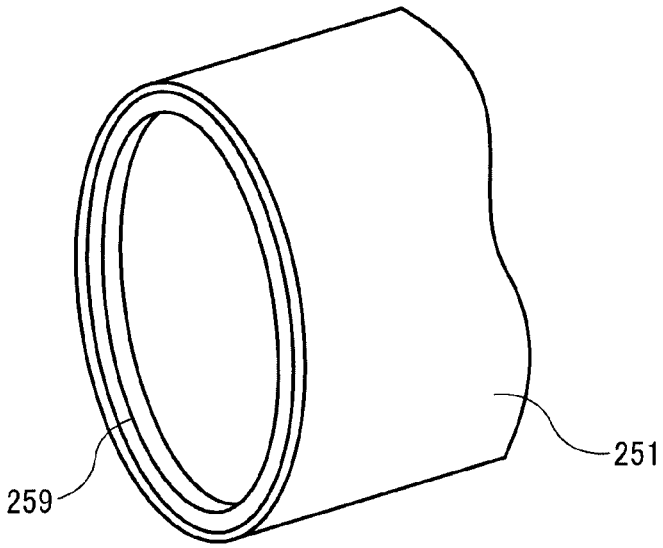
FIG. 4 is a perspective view illustrating the endless belt shown in FIG. 2.

FIG. 4 is a perspective view illustrating the endless belt end on which the ring shape edge 259 is provided.

It is to be noted that, hereinafter, the first endless fixing-belt 251*a* and the second endless fixing-belt 251*b* are simply referred to as the endless belts 251 collectively when discrimination therebetween is not necessary, and a first ring shape edge 259*a* and a second ring shape edge 259*b* are simply referred to as the ring shape edges 259 collectively when discrimination therebetween is not necessary.

As shown in FIG. 4, the ring shape edges 259 are provided on the inside surface of the end of the endless belts 251. In cross section, the ring shape edges 259 are formed in a quadrangle or a trapezoid shape. The ring shape edges 259 are made from heat-resistant elastic material such as a Silicone rubber. The ring shape edges 259 adhere to the inside surface of the endless belts with adhesives. The method of fixing by adhesion is easy to manufacture. The ring shape edges 259 can be replaced with the method of fixing by adhesion material, and can also be formed in one with the endless belts 251. The ring shape edges 259 can be formed in the polyimide resin, which is the base material of the endless belts 251, with a pressed mold heated to high temperature. Thus, since adhesives are unnecessary, the method of forming with the pressed mold is low cost, and is excellent also in heat resistance and durability.

Next, bias of the belts is described below with reference to FIG. 2.

The endless belts 251 translate in an axial direction while rotating such that they approach one side of the belt-fixing device 25. If the endless belts 251 are allowed to continue translating (the belts approach one side of the belt-fixing device 25 in the axial direction), the endless belts 251 may collide with the side boards 280 and the endless belts 251 may be damaged. Because the ring shape edges 259 hit the edge of the rollers 252 and 253, even when the endless belts 251 come near to one side of the belt-fixing device 25, by installing the ring shape edges 259 on an inner side of the edge of the endless belts 251, the endless belts 251 are prevented from coming near the sideboards 280. However, if the ring shape edges 259 pass by the end of the rollers 252 and 253, such that the rollers 252 and 253 no longer stop the ring shape edges 259 of the endless belts 251, then the endless belts 251 may hit the side boards 280 and may be damaged.

Then, in order to solve the problem, the fixing device 25 of the present embodiment sandwiches the ring shape edge 259 of the endless belts 251 with bearings of the rollers 252 and 253, which contact via the endless belts 251.

Figure 5:
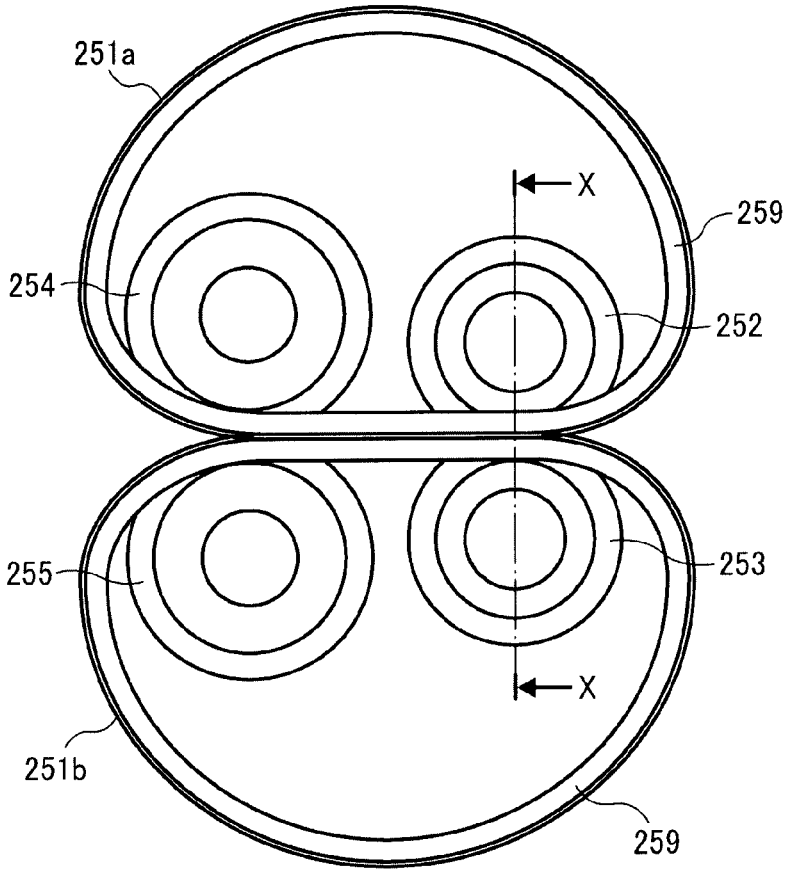
FIG. 5 is a cross-sectional diagram of the belt-fixing device in which the relationship between rollers and a ring shape edge of the endless belt is shown.

FIG. 5 is a cross-sectional diagram of the belt-fixing device in which the relationship between the rollers and the ring shape edges of the endless belts is shown.

Figure 6:
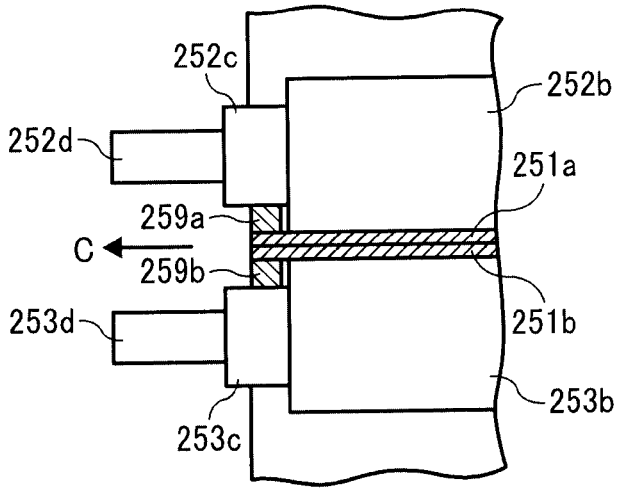
FIG. 6 is a partial cross sectional view of FIG. 5 in the X direction, and shows an embodiment in which the ring shape edge of the endless belt is sandwiched by the bearings of the first and second rollers.

FIG. 6 is a fragmentary sectional view of FIG. 5 in the X direction, and shows the state where the ring shape edges of the endless belts and the bearings of the rollers touch. The bearing 252*c* of the first guide-roller 252 contacts the ring shape edge 259*a* of the first endless fixing belt 251*a*. The bearing 253*c* of the second guide-roller 253 contacts the ring shape edge 259*b* of the second endless fixing belt 251*b*. The bearing 252*c* of the first guide-roller 252 and the bearing 253*c* of the second guide-roller 253 set and sandwich the ring shape edge 259*a* of the first endless belt 251*a* and the ring shape edge 259*b* of the second endless belt 251*b*. As each ring shape edge is sandwiched between the other ring shape edge and a bearing, there is little or no clearance between the ring shape edges 259*a* and 259*b* and the bearings 252*c* and 253*c*. The bearings 252*c* and 253*c* may or may not apply pressure to the ring shape edges 259*a* and 259*b*. Accordingly, movement of the ring shape edges 259 on the guide rollers 252 and 253 can be controlled (the ring shape edge 259 can be prevented from passing by the edge of the guide rollers 252 and 253). Specifically, when the endless belt tries to move laterally, the ring shape edge is held in place by the other ring shape edge and the bearings. Thus, the belt does not bend and the ring shape edge does not pass by the edge of the roller.

Moreover, in an exemplary embodiment, the bearings 252*c* and 253*c* press the ring shape edges 259 so that the ring shape edges 259 change shape with pressure and a thickness of the ring shape edges 259 shrinks. The compression of the ring shape edges 259 by the bearings 252*c* and 253*c* prevents the endless belts 251 from moving in an axial direction C of the guide rollers 252 and 253. Therefore, contact between the endless belts and the side boards 280 can be prevented.

The fixing device shown in FIG. 6 sandwiches the ring shape edge 259*a* of the first endless belt 251*a* and the ring shape edge 259*b* of the second endless belt 251*b* with the first guide-roller 252 and the second guide-roller 253. However, belt fixing device 25 may also sandwich the ring shape edges 259 of the endless belts 251 with bearings of the nip rollers 254 and 255 instead of the bearings of the guide-rollers 252 and 253.

Moreover, the belt fixing device 25 may sandwich the ring shape edges 259 of the endless belts 251 with the bearings of all rollers 252, 253, 254 and 255.

Figure 7:
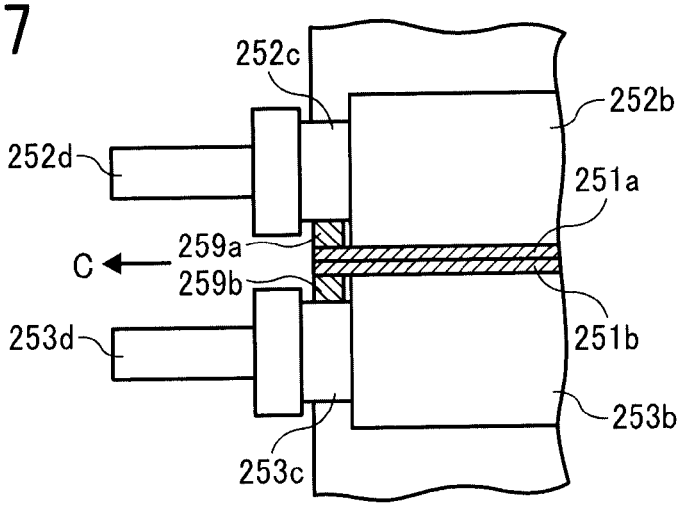
FIG. 7 is a partial cross sectional view of FIG. 5 in the X direction, and shows an embodiment that is different from FIG. 6.

FIG. 7 shows a modification of FIG. 6 in which the bearings of guide rollers form grooves.

The bearings 252*c* and 253*c* have a groove. The ring shape edge 259*a* of the first endless belt 251*a* contacts the groove of the bearing 252*c* of the first guide-roller 252. The ring shape edge 259*b* of the second endless belt 251*b* contacts the groove of the bearing 253*c* of the second guide-roller 253.

Thus, since it is arranged so that the ring shape edge 259*a* may get into the groove of the bearing 252*c*, even if the endless belt 251*a* moves in the direction of an axis of the first guide roller 252 to some extent, it is stopped by the side wall of the groove. For this reason, the endless belt 251 is prevented from moving in the axial direction C.

Moreover, the bearing 252*c* of the first guide-roller 252 and the bearing 253*c* of the second guide-roller 253 set and sandwich the ring shape edge 259*a* of the first endless belt 251*a* and the ring shape edge 259*b* of the second endless belt 251*b*. For this reason, the bearings 252*c* and 253*c* can prevent the ring shape edges 259 from passing by edges of the guide rollers 252 and 253. Moreover, when the bearings 252*c* and 253*c* press the ring shape edges 259, the ring shape edges 259 change shape with pressure and a thickness of the ring shape edges 259 shrinks. The compression of the ring shape edges 259 by the bearings 252*c* and 253*c* prevents the endless belts 251 from moving in an axial direction C of the guide rollers 252 and 253. Therefore, contact between the endless belts and the side boards 280 can be prevented.

Figure 8:
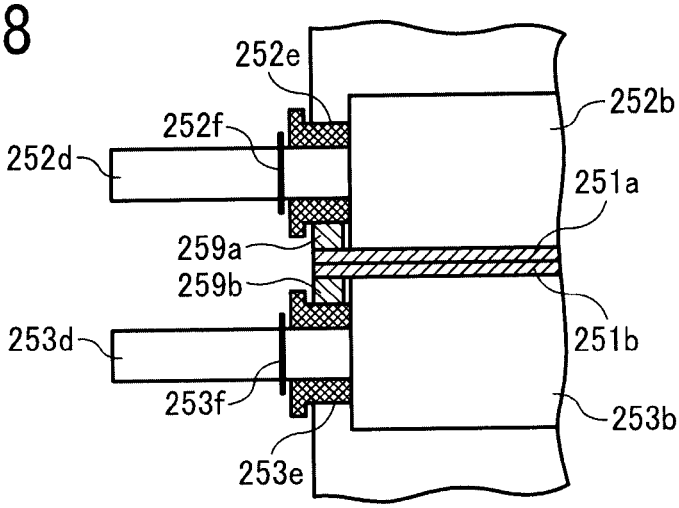
FIG. 8 is a partial cross sectional view of FIG. 5 in the X direction, and shows an embodiment that is different from FIG. 6.

FIG. 8 shows the modification of FIG. 6 and structure that the bearings rotate with respect to the rollers.

A first guide-roller rotation member 252*e* is provided on an axis 252*d* of the first guide-roller 252*b* so that the rotation member 252*e* rotates freely with respect to the axis 252*d*. A second guide-roller rotation member 253*e* is provided on an axis 253*d* of the second guide-roller 253*b* so that the rotation member 253*e* rotates freely with respect to the axis 253*d*. A stopper ring 252*f* and a stopper ring 253*f* are provided outside the rotation members 252*e* and 253*e* so that the rotation members 252*e* and 253*e* do not move along the axes 252*d* and 253*d*.

The rotation members 252*e* and 253*e* are used as a bearing and a collar of the ring shape edges 259*a* and 259*b*. The bearing can be a sliding bearing or a rolling element bearing such as ball bearings or roller bearings.

The ring shape edge 259*a* of the first endless belt 251*a* contacts the first guide-roller rotation member 252*e*. The ring shape edge 259*b* of the second endless belt 251*b* contacts the second guide-roller rotation member 253*e*. The rotation members 252*e* and 253*e* have a flange. Even if the endless belts 251*a* and 251*b* move in the axial direction C to some extent, they are stopped by the flange. Moreover, since the rotation members 252*e* and 253*e* rotate with respect to the axes 252*d* and 253*d*, even when the peripheral velocity of the axes 252*d* and 253*d* differ from the peripheral velocity of the ring shape edges 259, the endless belts 251 can move smoothly.

The size of each part material of the embodiments is shown below.

The diameters of endless belts 251 are 40 mm in the state before the endless belts 251 are wound around the rollers and belt guides. The endless belts 251 have a base layer, an elastic layer and a surface layer. The base layer has a layer thickness of a range from 40 μm to 80 μm and can be formed with resin such as polyimide. The elastic layer has a layer thickness of a range from 100 μm to 300 μm and can be formed with silicone rubber. The surface layer has a layer thickness of a range from 5 μm to 50 μm and can be formed with a material including fluorine such as tetrafluoroethylene-hexafluoropropylene copolymer (PFA).

The outer diameters of the guide rollers 252 and 253 are 15 mm, the outer diameters of the nip rollers 254 and 255 are 23 mm. The speed at which the endless belts 251 convey paper is in a range from 100 to 400 mm/second. The ring shape edges 259 have a thickness of a range from 1 mm to 5 mm and a width of a range from 3 mm to 6 mm in an axial direction. The bearings 252*c* and 253*c* have a width of a range from 4 mm to 8 mm and the widths are larger than the widths of the ring shape edges 259. The amount of deformation of the ring shape edges 259 (when the bearings 252*c* and 253*c* press the ring shape edges 259 so that the ring shape edges 259 are deformed by the pressure and thickness of the ring shape edges 259 shrink) is in a range from 0.2 mm to 1.0 mm.

Figure 9:
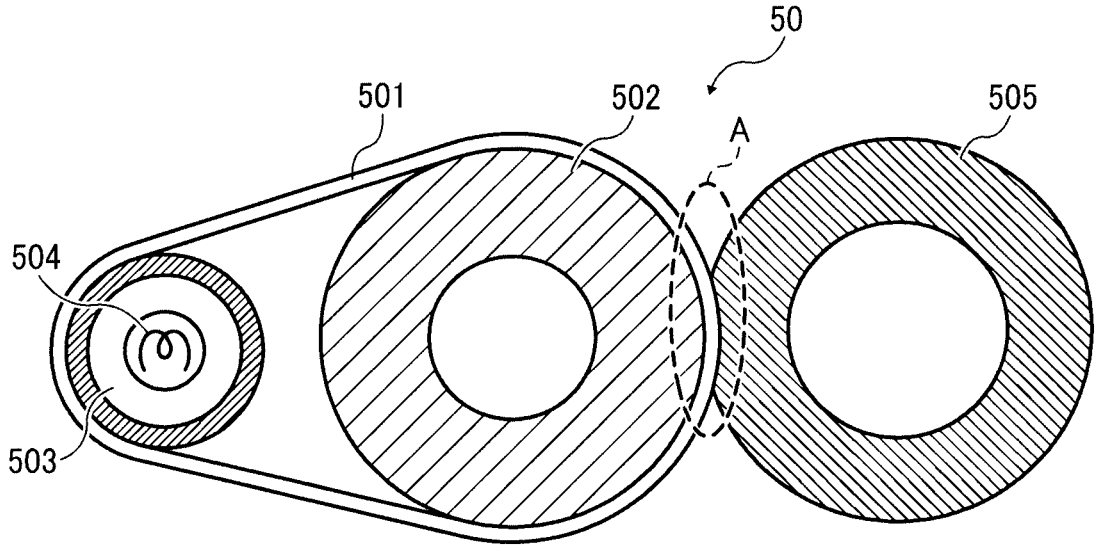
FIG. 9 is a cross-sectional diagram illustrating a configuration of the belt-fixing device, and shows a different embodiment from FIG. 2.

FIG. 9 is a cross-sectional diagram illustrating a configuration of the belt-fixing device of another embodiment.

The belt-fixing device 50 has a fixing roller 502, a heat roller 503, a pressure roller 505 and a fixing endless belt 501. The endless belt 501 is wound around the fixing roller 502 and the heat roller 503. A heater 504 such as a halogen heater is installed inside the heat roller 503. The heater 504 may be formed inside the endless belt 501, in order to heat the endless belt 501 directly.

A fixing nip area A is formed between the endless belt 501 and the fixing roller 502 by the pressure roller 505 pressing the fixing roller 502 via the endless belt 501. The fixing roller 502 and the pressure roller 505 have a core metal such as stainless steel and aluminum. An elastic layer is provided on the core metal and the elastic layer is formed with heat resistant materials such as fluoro rubber and silicon rubber. The thickness of an elastic layer is adjusted suitably. A release layer is provided on the elastic layer and the release layer is formed with a material including fluorine in order that a paper and a toner may be easily separated from the rollers 502 and 505. The heater, such as a halogen heater, may be installed internally in the core metal of the rollers 502 and 505.

The pressure roller 505 is pressed towards the fixing roller 502 by a spring (not shown) via the fixing belt 501. Additionally, the fixing nip area A is formed by the deformation of the elastic layers. A toner can be pressurized and heated at the fixing nip area A for a period of time. The width of fixing nip area A can be set to a desired value depending on the diameter, the thickness of the elastic layer, and hardness of the fixing roller 502 and the pressure roller 505. If sponge is used as the elastic layer, since sponge is highly insulative, it can shorten a warm-up time of the fixing device 50. Moreover, since the amount of deformation of the sponge is large, it can enlarge the width of the fixing nip area A. The pressure roller 505 is driven by a driving source (not shown) via a gear. The fixing roller 502 and the heat roller 503 are rotated together with the pressure roller 505 by sliding of the endless belt 501. A separating pick (not shown) for separating a paper from a pressure roller 505 is formed in the exit side of the fixing nip area A so that the pick contacts the surface of the pressure roller 505. A separating plate (not shown) for separating a paper from the fixing belt 501 is formed in the exit side of the fixing nip area A so that a small gap between the edge of the plate and the endless belt 501 is provided.

The heat roller 503 has given tension to the endless belt 501. The heat roller 503 is formed in the shape of a thin hollow cylinder and the heat roller 503 can be formed with aluminum, carbon steel and stainless steel.

If the heat roller 503 is made of aluminum with a thickness of a range from 1 mm to 4 mm, since the thermal conductivity of aluminum is good, a temperature distribution in the axial direction of the heat roller 503 can be made uniform. Furthermore, in order to prevent wear on the surface of the heat roller 503, the surface of the heat roller 503 is coated with anodic coating film.

A temperature sensor (not shown), such as a thermocouple or a thermistor, is arranged at the portion in which the endless belt 501 is coiled around the heat roller 503, in order to detect the temperature of the outside of the endless belt 501. According to the detection signal from the temperature sensor, operation of the heater 504 is controlled by a temperature controller (not shown).

The endless belt 501 has a base layer, an elastic layer and a surface layer. The base layer can be formed with heat resistant resin such as polyimide, polyamide, and polyamide imido, and with metal such as nickel, aluminum, and stainless steel. The base layer may be constituted by adding a nickel plate to polyimide resin. With such a composition, the endless belt 501 has strength and elasticity. As for the thickness of a base, 100 μm or less is desirable. The elastic layer can be formed with silicone rubber. The surface layer can be formed with a material including fluorine such as tetrafluoroethylene-hexafluoropropylene copolymer (PFA), polytetrafluoroethylene (PTFE), or tetrafluoroethylene-hexafluoropropylene copolymer (FEP).

Figure 10:
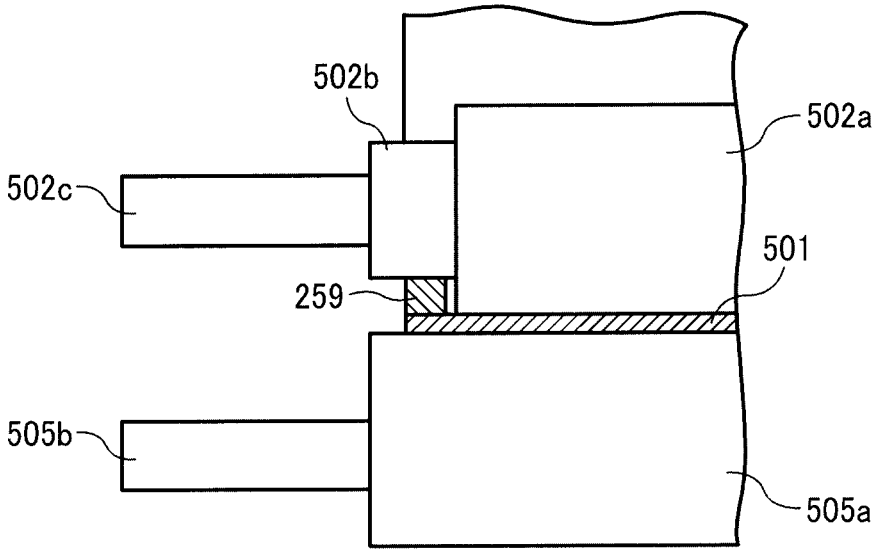
FIG. 10 is a partial cross sectional view of an exemplary belt-fixing device, and shows an embodiment in which the ring shape edge of the endless belt is sandwiched by a bearing of a first roller and a second roller.

FIG. 10 is a partial cross sectional view of FIG. 9, and shows the state where the ring shape edge of the endless belt 501 is sandwiched by a bearing of the first roller 502 and the second roller 505.

The fixing roller 502 has a roller part 502*a*, a bearing 502*b*, and an axial part 502*c*. The pressure roller 505 has a roller part 505*a* and an axial part 505*b*. The length in the axial direction of the pressure roller part 505*a* is larger than the fixing roller part 502*a*. The roller parts 502*a* and 505*a* have an elastic layer. The ring shape edge 259 of the endless belt 501 contacts the bearing 502*b*. The bearing 502*b* and pressure roller part 505*a* set and sandwich the ring shape edge 259. For this reason, the bearing 502*b* and pressure roller part 505*a* can control movement of the ring shape edge 259 and prevent the ring shape edge 259 from running aground on the fixing roller part 502*a* (the ring shape edge 259 does not pass by the edge of the fixing roller part 502*a*).

Figure 11:
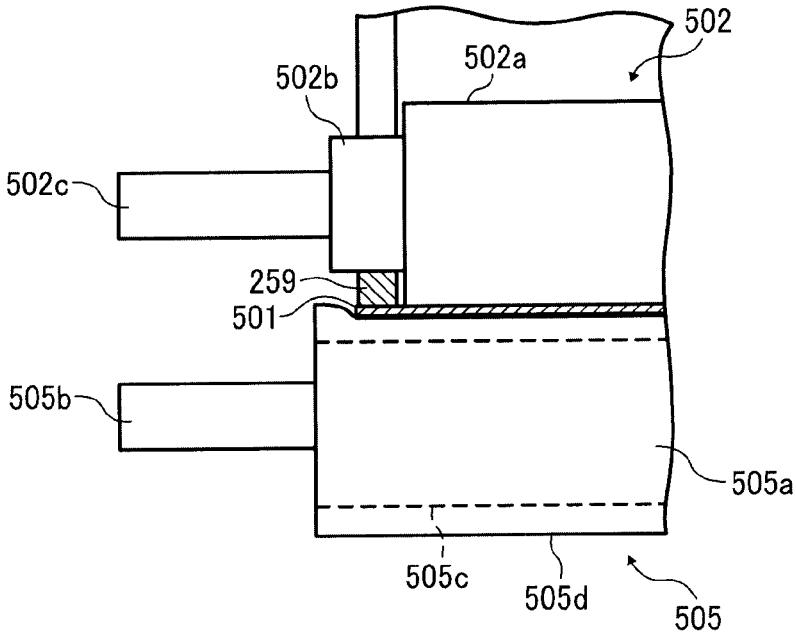
FIG. 11 is a partial cross sectional view of an exemplary belt-fixing device, and shows an embodiment that is different from FIG. 10.

FIG. 11 is a partial cross sectional view of FIG. 9, and shows a different embodiment from FIG. 10.

A fixing roller 502 has a fixing roller part 502*a*, a cylindrical core 502*b*, and an axis 502*c*. The diameter of cylindrical core 502*b* is smaller than the diameter of the fixing roller part 502*a*. Thus, The fixing roller 502 is formed so that the diameter of the fixing roller 502 becomes smaller at the end. A pressure roller 505 has a pressure roller part 505*a*, an axis 505*b*, a cylindrical core 505*c*, and an elastic layer 505*d*. The length in the axial direction of the pressure roller part 505*a* is larger than the fixing roller part 502*a*. The core 505*c* and the pressure roller part 505*a* press the ring shape edge 259 so that the ring shape edge 259 is deformed by the pressure and a thickness of the ring shape edges 259 shrink.

Figure 12:
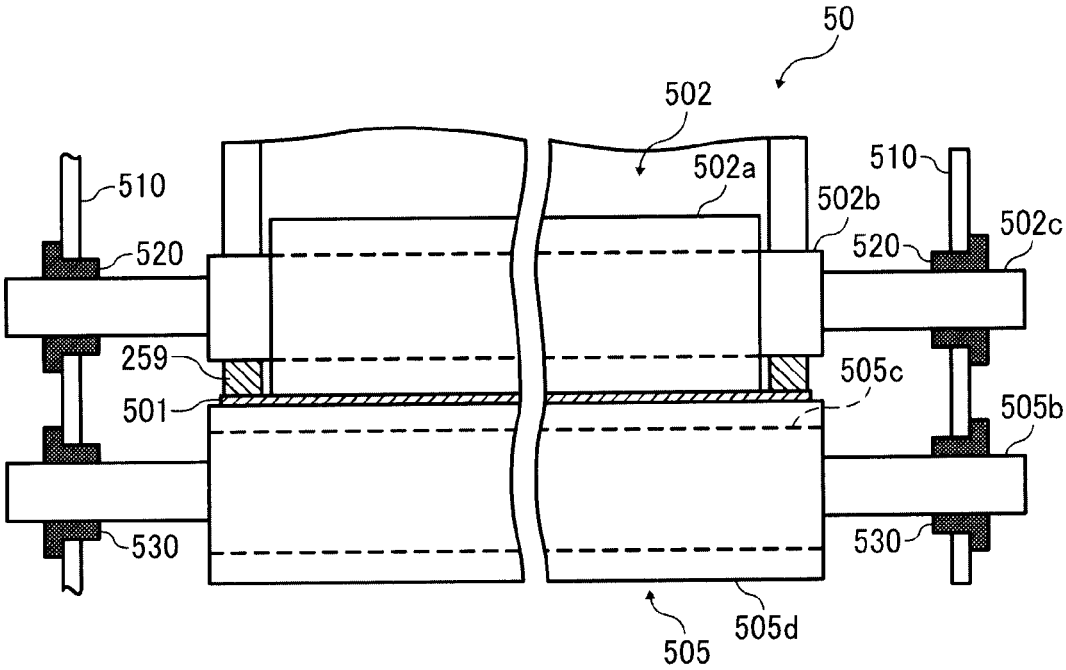
FIG. 12 is a partial cross sectional view of an exemplary belt-fixing device, and shows the same embodiment as FIG. 11.

FIG. 12 is a partial cross sectional view of FIG. 9, and shows the state where the fixing roller and pressure roller as shown FIG. 11 are attached to the side boards.

The axis 502*c* of the fixing roller 502 and the axis 505*b* of the pressure roller 505 are supported by the side boards 510 with the bearings 520 and 530.

Figure 13:
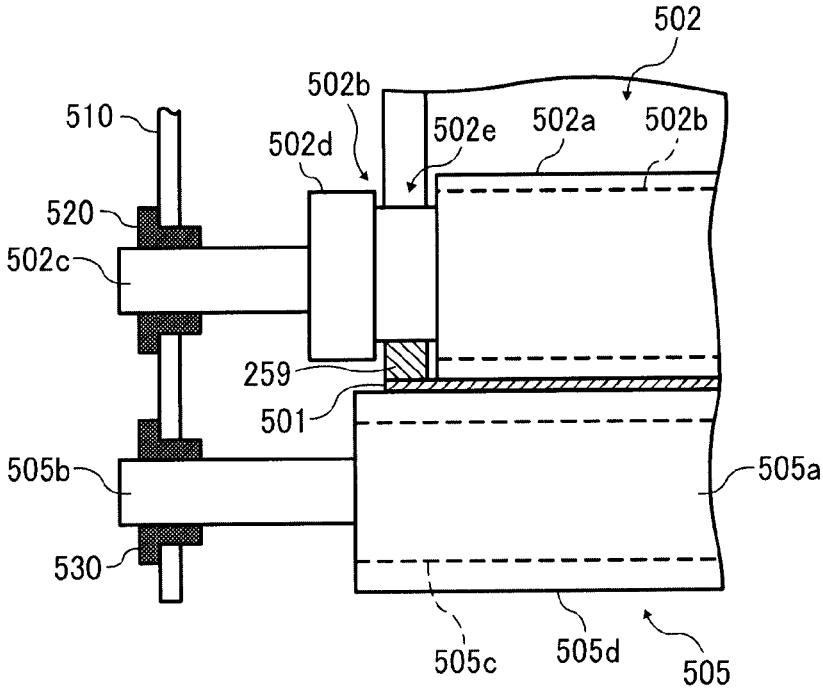
FIG. 13 is a partial cross sectional view of an exemplary belt-fixing device, and shows an embodiment that is different from FIG. 10.

FIG. 13 is a partial cross sectional view of FIG. 9, and shows a different embodiment from FIG. 10.

A groove 502*e* is formed in a cylindrical core 502*b* by providing a flange 502*d* in the end of the core 502*b*. The width of the groove 502*e* is slightly larger than the width of the ring shape edge 259. Even if the endless belt 501 moves in the axial direction to some extent, it is stopped by the flange 502*d* and the edge of the fixing roller part 502*a*. Explanation is omitted about the elements which are described in other embodiments.

Figure 14:
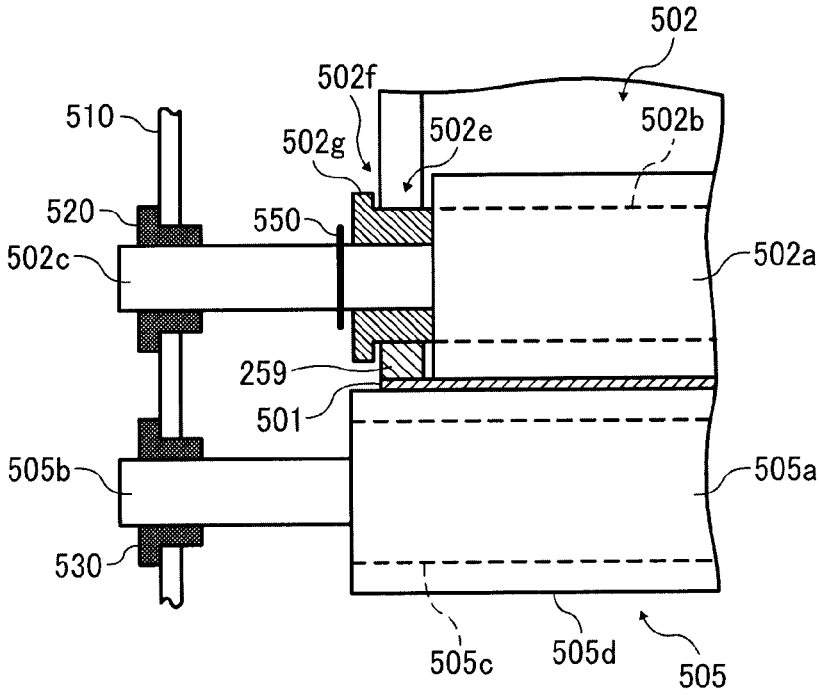
FIG. 14 is a partial cross sectional view of an exemplary belt-fixing device, and shows an embodiment that is different from FIG. 10.

FIG. 14 shows a modification of FIG. 10 in which the bearing rotates with respect to the roller.

A bearing 502*f* as a rotation member is provided on an axis 502*c* of the fixing roller 502 so that the bearing 502*f* rotates freely with respect to the axis 502*c*. A stopper ring 550 is provided outside the bearing 502*f* so that the bearing 502*f* does not move down the axis 502*c*. The bearing 502*f* has a flange 502*g*. A groove 502*e* is formed in the bearing 502*f* by providing the flange 502*g* in the end of the bearing 502*f*. Explanation is omitted about the elements which are described in other embodiments.

Next, damage of the belt is described below with reference to FIG. 15 and FIG. 16.

Figure 15:
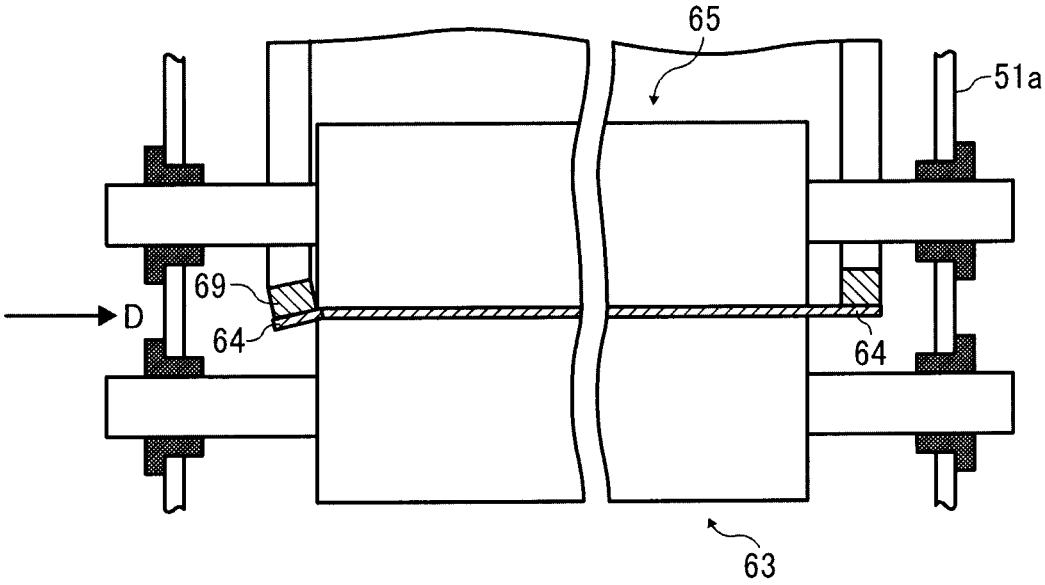
FIG. 15 shows an embodiment in which the end of the fixing belt bends.

FIG. 15 shows the state where the end of the fixing belt bends.

The ring shape edge 69 does not contact the pressure roller 63. The ring shape edge 69 does not come in contact with the pressure roller 63 because the length of the fixing roller 65 is the same as the length of the pressure roller 63. That is, the ring shape edge 69 is not supported with the pressure roller 63. If the fixing belt moves in the direction D such that the ring shape edge 69 touches the edge of the fixing roller 65, then a force is applied to the fixing belt 64 that will cause the fixing belt 64 to bend.

Figure 16:
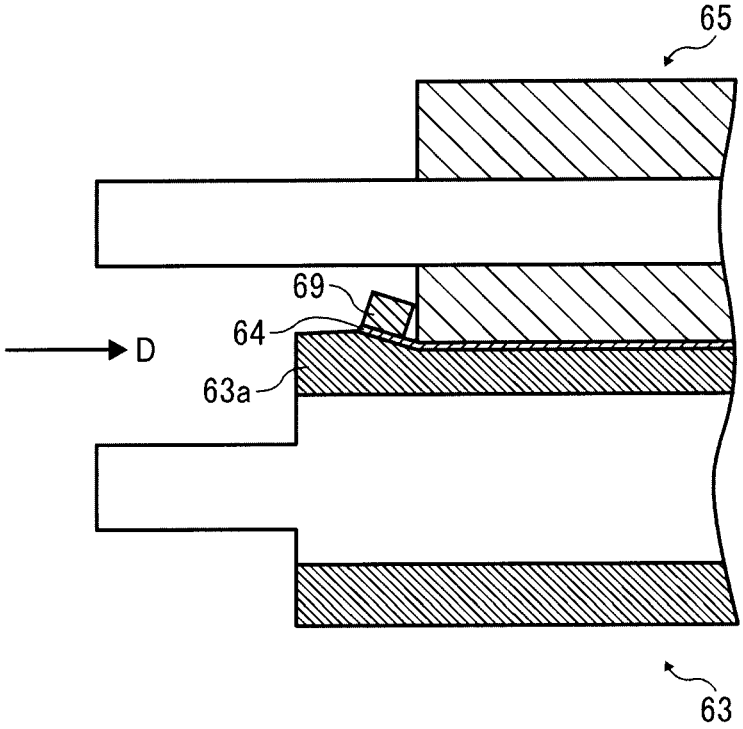
FIG. 16 shows another embodiment in which the end of the fixing belt bends.

FIG. 16 shows the state where the end of the fixing belt bends.

The ring shape edge 69 is supported by the pressure roller 63. However, the ring shape edge 69 does not contact a bearing and cylindrical core as shown FIG. 10 and FIG. 11.

The pressure roller 63 has an elastic layer 63*a*. Since the elastic layer 63*a* changes thickness as shown in FIG. 16, the fixing belt 64 may bend towards the fixing roller in response to force from the end of the pressure roller 63.

Thus, if the force which bends the fixing belt 64 acts over a long period of time repeatedly as shown in FIG. 15 and FIG. 16, the fixing belt 63 will crack. This crack becomes the cause of damaging the fixing belt 64. Moreover, if the force in the direction D acting on the fixing belt 64 becomes still larger, the ring shape edge 69 will no longer be stopped by the fixing roller 65 and the ring shape edge 69 will pass by the edge of the fixing roller and the fixing belt 64 will translate further in the axial direction such that it will hit the side board 51*a*.

When the fixing belt 64 is a metal belt, this tendency is greater that in the case of a resin belt.

Numerous additional modifications and variations are possible in light of the above teachings. It is therefore to be understood that, within the scope of the appended claims, the disclosure of this patent specification may be practiced otherwise than as specifically described herein.

What is claimed is:

1. A belt-fixing device, comprising:

an endless belt;

a first roller disposed inside the endless belt, the first roller including a first bearing;

a second roller disposed in contact with the first roller via the endless belt, to form a fixing nip therebetween through which a recording medium passes; and a ring shape edge to control movement of the belt in an axial direction, provided on an inner surface of the endless belt;

wherein the ring shape edge is positioned between the first roller and the second roller and the first bearing of the first roller is disposed in direct contact with the ring shape edge.

2. The belt-fixing device according to claim 1, wherein the ring shape edge is pressed by the first roller and the second roller.

3. The belt-fixing device according to claim 2, wherein an amount of deformation of the ring shape edge is in a range from 0.2 mm to 1.0 mm.

4. The belt-fixing device according to claim 1, wherein the ring shape edge is positioned between the first bearing and the second roller.

5. The belt-fixing device according to claim 4, further comprising:

a flange provided with the first bearing, wherein the flange forms a groove that the ring shape edge fits in.

6. The belt-fixing device according to claim 4, wherein the first bearing rotates with respect to the first roller.

7. The belt-fixing device according to claim 6, further comprising:

a flange provided with the first bearing, wherein the flange forms a groove that the ring shape edge fits in.

8. The belt-fixing device according to claim 1, further comprising:

a second bearing provided with the second roller, wherein the ring shape edge is positioned between the first bearing and the second bearing.

9. A belt-fixing device, comprising:

a first endless belt;

a second endless belt disposed in contact with the first belt, to form a fixing nip therebetween through which a recording medium passes;

a first roller disposed inside the first endless belt;

a second roller disposed inside the first endless belt, upstream from the first roller in a direction in which the recording medium is conveyed;

a third roller disposed inside the second belt, facing the first roller to cause the first belt and the second belt to press against each other at the fixing nip;

a fourth roller disposed inside the second belt, facing the second roller to cause the first belt and the second belt to press against each other at the fixing nip;

a first ring shape edge to control movement of the first belt in an axial direction, provided on an inner surface of the first belt; and a second ring shape edge to control movement of the second belt in the axial direction, provided on an inner surface of the second belt;

wherein the first ring shape edge and the second ring shape edge are positioned between the first roller and the third roller.

10. The belt-fixing device according to claim 9, wherein the first ring shape edge and the second ring shape edge are pressed by the first roller and the third roller.

11. The belt-fixing device according to claim 9, wherein an amount of deformation of the first ring shape edge and the second ring shape edge is in a range from 0.2 mm to 1.0 mm.

12. The belt-fixing device according to claim 9, further comprising:

a first bearing provided with the first roller;

a second bearing provided with the third roller;

wherein the first ring shape edge and the second ring shape edge are positioned between the first bearing and the second bearing.

13. The belt-fixing device according to claim 12, further comprising:

a first flange provided with the first bearing, and the first flange forms a first groove that the first ring shape edge fits in;

a second flange provided with the second bearing, and the second flange forms a second groove that the second ring shape edge fits in.

14. The belt-fixing device according to claim 12, wherein the first bearing rotates with respect to the first roller and the second bearing rotates with respect to the third roller.

15. The belt-fixing device according to claim 14, further comprising:

a first flange provided with the first bearing, and the first flange forms a first groove that the first ring shape edge fits in;

a second flange provided with the second bearing, and the second flange forms a second groove that the second ring shape edge fits in.

16. An image forming apparatus, comprising:

an image carrier on which an electrostatic latent image is formed;

a developing unit to develop the latent image on the image carrier into a toner image;

a transfer unit to transfer the toner image onto a recording medium; and a belt fixing device including an endless belt, a first roller disposed inside the endless belt, the first roller including a first bearing, a second roller disposed in contact with the first roller via the endless belt, to form a fixing nip therebetween through which a recording medium passes, and a ring shape edge to control movement of the belt in an axial direction, provided on an the inner surface of the endless belt, wherein the ring shape edge is positioned between the first roller and the second roller and the first bearing of the first roller is disposed in direct contact with the ring shape edge.

17. The image forming apparatus according to claim 16, wherein an amount of deformation of the ring shape edge is in a range from 0.2 mm to 1.0 mm.

18. The image forming apparatus according to claim 16, further comprising:

a flange provided with the first bearing, wherein the ring shape edge is positioned between the first bearing and the second roller, and wherein the flange forms a groove that the ring shape edge fits in.

19. The image forming apparatus according to claim 18, wherein the first bearing rotates with respect to the first roller.

20. The image forming apparatus according to claim 16, further comprising:

a second bearing provided with the second roller, wherein the ring shape edge is positioned between the first bearing and the second bearing.

* * * * *